United States Patent [19]

Lawson

[11] Patent Number: 4,751,548

[45] Date of Patent: Jun. 14, 1988

[54] APPARATUS INCLUDING A CONDUCTIVE WICK FOR APPLYING LIQUID RELEASE AGENT MATERIAL TO A HEATED FUSER ROLL

[76] Inventor: David J. Lawson, 42 Marsden Green, Welwyn Garden City, Hertfordshire LA8 6YB, United Kingdom

[21] Appl. No.: 49,188

[22] Filed: May 12, 1987

[30] Foreign Application Priority Data

May 13, 1986 [GB] United Kingdom ..... 8611609

[51] Int. Cl.[4] ..... G03G 15/20

[52] U.S. Cl. ..... 355/3 FU; 118/60; 118/260; 118/268; 219/216; 361/212; 361/221; 430/99

[58] Field of Search ..... 355/3 FU, 15, 14 FU, 355/3 R; 118/60, 101, 260, 268, 652; 219/216; 432/60, 228; 361/212, 214, 220–222; 430/99

[56] References Cited

U.S. PATENT DOCUMENTS

| | | | |
|---|---|---|---|
| 3,288,175 | 11/1966 | Valko | 139/425 |
| 3,745,972 | 7/1973 | Thettu | 118/60 X |
| 3,839,135 | 10/1974 | Lowry et al. | 361/220 X |
| 3,846,151 | 11/1974 | Roteman et al. | 361/221 X |
| 3,952,696 | 4/1976 | Saupe | 219/216 X |
| 4,083,322 | 4/1978 | Beckman, Jr. | 355/3 FU X |
| 4,182,263 | 1/1980 | Naeser et al. | 118/60 |
| 4,309,957 | 1/1982 | Swift | 118/60 |
| 4,536,076 | 8/1985 | Bickerstaff et al. | 355/3 |

FOREIGN PATENT DOCUMENTS

| | | | |
|---|---|---|---|
| 0053874 | 3/1984 | Japan . | |
| 0090876 | 5/1984 | Japan | 355/3 FU |
| 0157673 | 9/1984 | Japan | 430/99 |
| 0014648 | 1/1986 | Japan | 355/15 |

*Primary Examiner*—A. T. Grimley
*Assistant Examiner*—John G. Smith

[57] ABSTRACT

A heat and pressure fuser for fixing a toner image to a copy sheet in a xerographic copier has a heated fuser roll cooperating with a backup roll to form a nip through which the copy sheets are passed for fusing. In order to prevent toner offset the fuser roll is provided with a coating of silicone rubber or Viton (trademark) and the outer surface is supplied with a film of liquid release agent. The release agent is contained in a sump and fed to an applicator having a wick bearing against the fuser roll. Static buildup on the fuser roll is avoided because the wick is electrically conductive and is connected to earth potential via the copier frame providing a charge leakage path for the fuser roll. In a preferred form, the wick comprises a woven fabric in which the weft threads are electrically conductive, each such conductive thread comprising one or more stainless steel fibers entwined with a plurality of heat-resistive nylon, e.g. Nomex (trademark), fibers.

14 Claims, 2 Drawing Sheets

APPARATUS INCLUDING A CONDUCTIVE WICK FOR APPLYING LIQUID RELEASE AGENT MATERIAL TO A HEATED FUSER ROLL

BACKGROUND OF THE INVENTION

This invention relates generally to a fusing apparatus for fixing toner images on copy substrates, and more particularly to such an apparatus which affects fusing by the combined application of heat and pressure. This fusing apparatus is suitable for use in an electrostatographic recording machine such as, for example, a xerographic copier.

In a xerographic copier a light image of an original document to be reproduced is recorded in the form of a latent electrostatic image on a photosensitive member. The latent image is rendered visible by the application of a resin-based powder known as toner. The visual toner image is transferred electrostatically from the photosensitive member onto sheets of paper or other substrates. The toner image is then fixed or "fused", for example by applying heat and pressure, which causes the toner material to become soft and tacky whereby it is able to flow into the fibres or pores of the substrate or otherwise upon the surface thereof. Thereafter, as the toner material cools, it solidifies and is bonded firmly to the substrate. In the electrostatographic art generally the use of thermal energy and pressure for fixing toner images on to a substrate is well known.

It has long been recognised that one of the fastest and most positive methods of applying both heat and pressure for fusing the toner image to the substrate is by direct contact of the resin-based toner image with a hot surface, such as a heated roll which also applies pressure to the substrate. One approach is to pass the substrate with the toner image thereon between a pair of opposed roller members forming a nip, at least one of the rollers being internally heated. The actual temperature and pressure ranges will of course vary depending upon the softening range of the particular resin used in the toner. Typically, however, it will be necessary to heat the toner powder above 180° C. Temperatures of 198° C. or even higher are not uncommon in commercial fusers. Corresponding nip pressures are in the range of 690 to 1380 $kNm^{-2}$.

A problem with this kind of fuser is that, as the toner becomes tacky, it can stick to the surface of the fuser roll which is undesirable because some of the toner on the fuser roll can then be transferred to subsequent substrates being fused and, moreover, those subsequent substrates will in their turn give rise to even more toner sticking to the fuser roll. This effect, known as "offset", clearly impairs copy quality. Furthermore, if the rollers are rotated when there is no substrate present in the nip therebetween, toner may also be transferred from the fuser roll to the backup roll so that when a substrate subsequently passes through the nip some of the toner may be transferred to the reverse side thereof.

An arrangement for minimising the problem of offset has been to provide a fuser roll with an outer surface or covering of, for example, polytetrafluorethylene, known by the trade name Teflon, to which a liquid release agent such as silicone oil is applied. The thickness of the Teflon is typically of the order of tens of microns and the thickness of the oil is less than 1 micron. Silicone based oils, for example polydimethylsiloxane, which possess a relatively low surface energy, have been found to be suitable for use in the heated fuser roll environment where Teflon constitutes the outer surface of the fuser roll. In practice, a thin layer of silicone oil is applied to the surface of the heated roll to form an interface between the roll surface and the toner images carried on the substrate. Thus, a low surface energy layer is presented to the toner as it passes through the fuser nip thereby preventing toner from offsetting to the fuser roll surface.

In attempts to improve the quality of the image fused by a heat roll fuser, such rolls have been provided with conformable surfaces comprising silicone rubber or Viton (trademark of E.I. duPont for a series of fluoroelastomers based on the copolymer of vinylidene fluoride and hexafluoropropylene). As in the case of the Teflon coated fuser roll, release fluids such as silicone based oils are applied to the surface of the silicone rubber or Viton to both minimise offsetting and to facilitate stripping. When the fuser system is one which provides for applying silicone oil to silicone rubber or Viton, a low viscosity silicone oil (i.e. in the order of 100 to 1000 centistokes) has most commonly been employed, although liquids of relatively high viscosity, for example 12,000 to 60,000 centistokes and higher, have also been used.

Various forms of applicators have been employed to supply the liquid release agent to the surface of the fuser roll, but perhaps the most straightforward technique is to use a wick, a part of which engages the surface of the roller and another part of which is immersed in a source of release agent contained in a reservoir. The wick is commonly made of a heat resistive nylon material called Nomex (trademark of E.I. duPont). U.S. Pat. No. 4,309,957 discloses a two-layer wick comprising a working surface material, such as felted or fibrous Teflon which contacts the fuser roll surface, and a backing material such as fibrous or felted Nomex to which the working surface material is needled. The release agent is conveyed from a supply reservoir to the backing layer by an annular conveying member.

U.S. Pat. No. 3,952,696 to Saupe discloses a fixing device which applies silicone oil to the heated fusing roll. This patent incorporates a heat insulating rotational support and a heat insulating web which extends partially around the roll (providing pressure engagement between the roll and copy). The web is securely fixed at one end, and is tensioned by a spring at the other end (see FIGS. 1 and 2). U.S. Pat. No. 4,182,263 to Naeser et al. discloses an applicator mechanism which applies fusing oil to a fixing roller. The oil is fed through a supply chamber into a first wick (felt) through openings in the chamber. This wick then transfers the oil to a second movable wick mounted upon supply/take-up reels. The second wick is urged into contact with the roller by two guide members.

U.S. Pat. No. 4,536,076 to Bickerstaff et al. discloses a liquid application apparatus consisting of two wick members - a supply wick and an applicator wick - and a reservoir above the wick secured to a manifold member. Liquid is delivered to the reservoir by a pump. Multiple orifices in the manifold permit the liquid to pass from the reservoir into the wick members. The applicator wick is secured in place by clips attached to its ends. The application apparatus is urged into contact with the fuser roll by spring members.

Another problem which is encountered in the prior art is that the fuser roll tends to become electrostatically charged during operation. This can be atributed to two main causes; the first being the triboelectric effect as the substrates, e.g. sheets of paper, are conveyed past the fuser roll in contact therewith, and the second being the transfer to the fuser roll of electrostatic charge which may already be present on the substrate from previous processing operations. One consequence of the fuser roll becoming charged is that the copy substrate will tend to stick to it giving rise to stripping problems. Perhaps more seriously, however, is the danger of electrostatic discharge. The charging effect is of course cumulative and the electrostatic charge on the fuser roll may build up to a level as high as 2 to 3 kV whereupon it will tend to discharge to the main frame of the machine which generally is maintained at earth potential. The result is an electrical noise spike which can be sufficiently severe as to adversly affect the electrical control system of the xerographic machine and may cause the machine to reset itself to the default condition (i.e. in readiness to start a new job) while a copy run is still in progress, or it may even lead to total shutdown or failure of the whole machine.

Attempts have been made to overcome this problem. For example the fuser roll has been mounted in electrically conductive bearings in the frame of the copier which is earthed thus providing a leakage path to earth. This solution is not entirely satisfactory however because the conductive bearings also provide an undesirable thermal path to the machine frame which reduces the efficiency of the heated roll, and furthermore does not effectively remove the electrostatic charge at the roll surface.

Japanese Patent Document No. 0053874 to Sakurai discloses a fixation device which includes a conductive needle like member in contact with either a heated fixing roll or a back-up roll. The conductive member prevents the build-up of electrostatic charge on the roll. The member may be composed of a combination of metallic and carbon fibers.

U.S. Pat. No. 3,288,175 to Valko discloses a textile material which conducts electricity, but this is not a wick material. The material is composed of non-metallic threads in a continuous system of metallic fibers (up to 10 percent). The material conducts electricity and has the aesthetic properties of a non-metallic textile.

SUMMARY OF THE INVENTION

According to the present invention there is provided a fusing apparatus for fixing toner images to copy substrates comprising a heated fuser roll, a backup roll cooperating with said fuser roll to form a nip through which are passed said copy substrates, a sump for storing liquid release agent, means for conveying the release agent from the sump to wick means diposed adjacent the fuser roll for supplying the liquid release agent to the surface of said fuser roll, wherein the wick means is adapted to be electrically conductive and is electrically connected to earthing means.

A fusing apparatus in accordance with the invention has the advantage that the wick not only supplies the release agent to the surface of the fuser, but, being electrically conductive, also provides a leakage path for the electrostatic charge on the fuser roll surface. Suitably, the wick is supported in and electrically connected to a frame, preferably the main frame of the xerographic machine of which the fusing apparatus forms a part, which is maintained at earth potential. The fuser roll may be journalled in the frame in bushes which are both thermally and electrically insulating thus reducing heat loss to the frame and optimising the efficiency of the fuser roll.

The wick may be in the form of either a felt or a woven fabric made from electrically conductive threads. The individual threads may be formed by entwining one or more electrically conductive fibres with a plurality of electrically insulating, e.g. Nomex (trademark), fibres. In the case of the woven fabric the warp and the weft need not both comprise electrically conductive threads.

In a preferred embodiment the wick means comprises a first wick member in the form of a felt pad, and a second wick member in the form of a woven fabric, the second wick member being disposed between the first wick member and the surface of the fuser roll whereby the liquid release agent is supplied to the surface of said fuser roll from said first wick member via said second wick member, said second wick member being less absorbent than said first wick member. This arrangement has the advantage of enabling a more even distribution of a small quantity of the liquid release agent to be supplied to the surface of the fuser roll.

An embodiment of the invention will now be described, by way of example, with reference to the accompanying drawings, in which:

DESCRIPTION OF THE PREFERRED EMBODIMENTS

Figure 1:
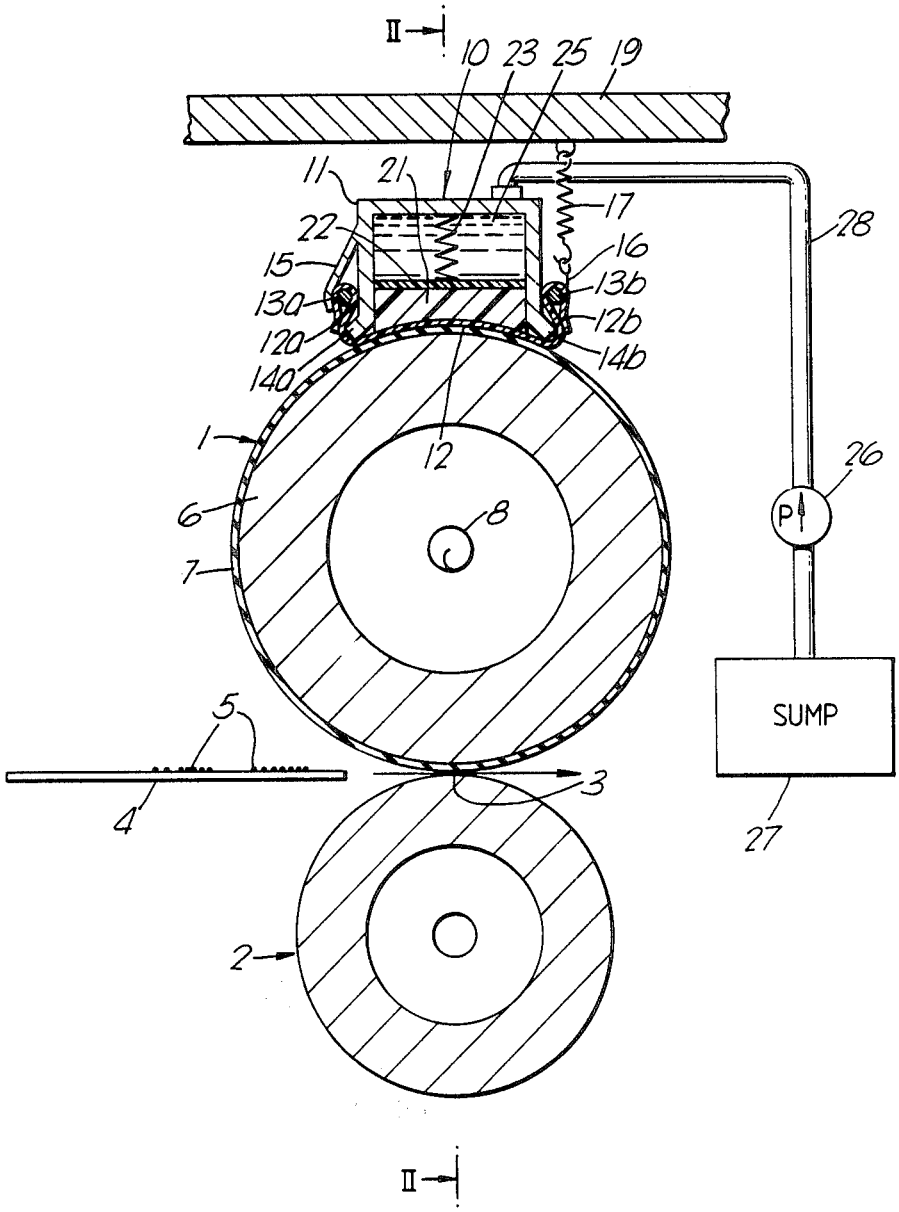
FIG. 1 is a schematic transverse section of a fusing apparatus in accordance with the present invention.
Figure 2:
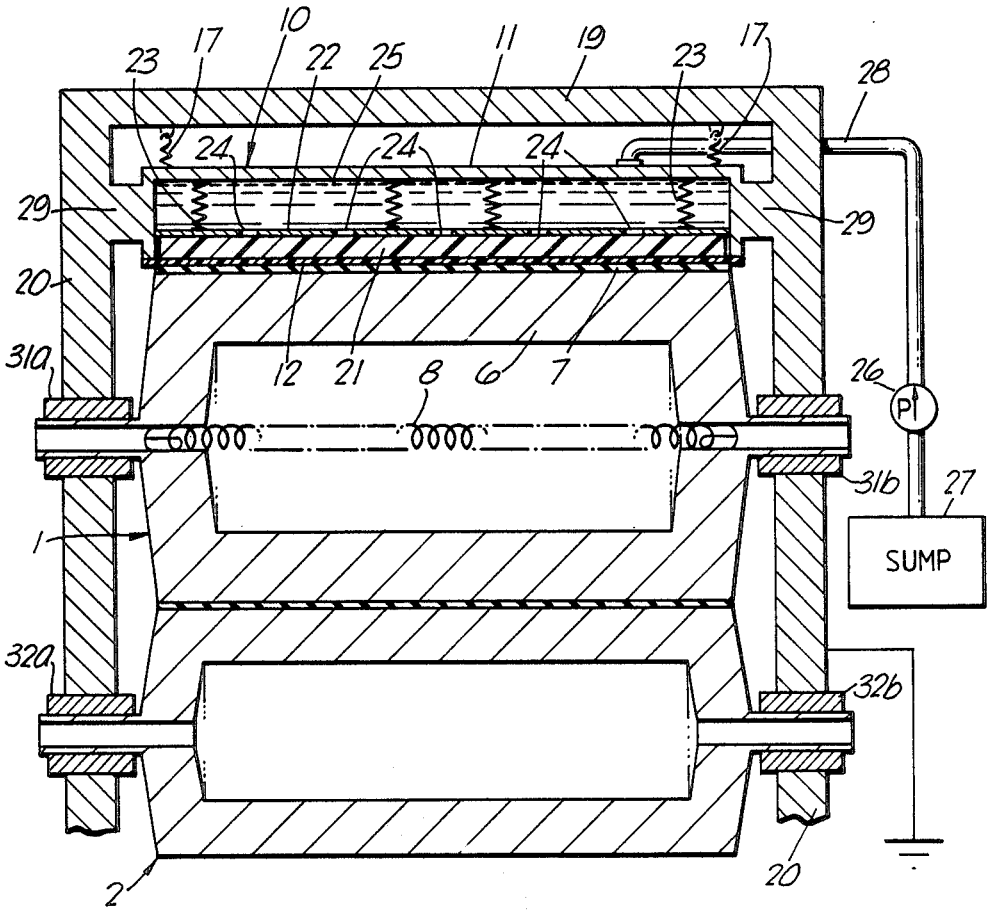
FIG. 2 is a schematic sectional view taken on the line II—II in FIG. 1.

As shown in FIGS. 1 and 2, the fusing apparatus comprises a fuser roll 1 and a smaller diameter backup roll 2 cooperating with the fuser roll 1 to form a nip 3 into which can be introduced in the direction of the arrow a copy sheet 4 having at its upper surface, i.e. the surface adjacent fuser roll 1, a toner image 5 to be fixed by fusing to the sheet, in known manner.

The fuser roll 1 which may have a diameter of, for example 5 cm, comprises a metal core 6 on which a silicone rubber of Viton (trademark) coating 7 is provided. The metal core 6 is preferably made of aluminium and may be, for example 8 mm thick, whereas the coating 7 is only approximately 1 mm thick. As is well known, the fuser roll 1 has a heater 8 provided internally. For the sake of clarity, the electrical connections to the heater are not shown in the Figures.

Backup roll 2 is substantially the same length as fuser roll 1, but has a smaller diameter of, for example, 4 cm. Roll 2 is made of Teflon coated mild steel, the thickness of which may be approximately 5 mm.

A release agent management system 10 is provided adjacent the fuser roll 1, and comprises an open-faced conduit 11 which is substantially U-shaped, but rectangular, in section. The conduit 11 is electrically conductive and may be made of, for example aluminium. As can be seen in FIG. 2, the conduit 11 is rigidly supported by electrically conductive supports 29 connected electrically to the machine frame 20 which is also electrically conductive. Extending across the open face of the conduit 11 is a rectangular sheet 12 of wick material to be described in more detail below. The open face of the conduit is thus substantially covered by the wick 12. The wick 12 has sewn along each of its longer sides a hem **12*a*, 12*b* into which is inserted a respective electrically conductive rod 13***a*, 13*b* extending the full length of the wick. The rods 13*a*, 13*b* may be made of, for example, steel. Rod 13*a* is seated against an outwardly flared lip 14*a* at the opening of the conduit 11 and is held in place by clip 15 which is formed integrally with the conduit 11. Rod 13*b* is engaged by a hook 16 attached to a tension spring 17 which is fastened to electrically conductive member 19 forming part of the overall machine frame 20 which, as is conventional, is electrically conductive and is connected to earth potential. The spring 17 causes the rod 13*b* to be pulled away from the outwardly flared lip 14*b* at the opening of the conduit 11, and pulls the wick sheet 12 moderately taught over the conduit opening. However, there is sufficient slack in the sheet 12 of wick material for it to follow the curvature of the fuser roll 1 against which the wick 12 bears. From within the conduit 11 the wick sheet 12 is pressed against the fuser roll 1 by a felt pad 21. The felt pad 21 may be made of Nomex (trademark) which, as mentioned previously is an insulating, heat resistive nylon material. The lateral dimensions of the felt pad 21 are chosen so that it provides a close fit against each of the walls of the conduit 11 thus in effect sealing the conduit. The felt pad 21, which may be for example 6 mm thick is provided on a backing plate 22 whose lateral dimensions are approximately the same as the felt pad 21 and which is biased towards the opening of the conduit by several metal compression springs 23 equally spaced along the length of the conduit. In FIG. 2 four such compression springs 23 are shown. The backing plate 22 which is electrically conductive and may be made of, for example steel, has a series of apertures 24, typically 10 mm in diameter, provided along its length. In FIG. 2, five such apertures 24 are shown, but there may of course be more or less than this number, and their size may be varied depending on the absorbency of the felt pad 21 and of the viscosity of the liquid release agent to be employed.

A liquid release agent 25 is supplied to the conduit 11 by a pump 26 from a sump 27 via a pipe 28. As mentioned previously, release agents in the form of silicone oils are well known in the art. The rate at which the oil is pumped depends on various factors, in particular the amount of oil to be supplied to the fuser roll for good release performance, the speed of which the fuser roll is rotating, the copy rate, the amount of non-useful oil (oil pools), and the viscosity the oil used. The oil 25 in the conduit 11 passes through the apertures 24 (and possibly also around the side of the backing plate if it does not form a tight seal with the conduit 11) and is absorbed by the felt pad 21 which in turn acts as a source of oil release agent for the wick 12. The wick 12 is less absorbent than the felt pad 21. Thus the felt pad 21 provides an abundant source of release agent while the less absorbent wick 12 has the advantageous effect of checking the supply of oil to the surface of the fuser roll 1 resulting in a more even distribution of a smaller quantity of oil.

The material of the wick 12 is itself electrically conductive. To this end the sheet of material may be a woven fabric in which individual threads are electrically conductive. The applicants have used a material in which the constituent electrically conductive thread has stainless steel strands or fibers entwined with a plurality of electrically insulating fibers made for example of Nomex (trademark). The thread may for example comprise between 5 and 20, and preferably about 10, stainless fibers and about 90 Nomex fibers. The thickness of the stainless steel fibers is of the same order as the Nomex fibers, for example 5–10 microns. The twisted conductive thread of stainless steel Nomex fibers has an overall thickness of approximately 0.1 mm. In a particular woven material used by the applicants, only the threads of the warp were electrically conductive of the form described above, whereas the threads of the weft were electrically insulating and comprised only conventional Nomex. An alternative would, of course, be to use electrically conductive weft threads and electrically insulating warp threads, or even to use electrically conductive threads for both the warp and the weft. In any case, the wick 12 is electrically conductive and as it physically contacts the fuser roll 1 provides a charge leakage path to earth via the other electrically conductive components with which it is in electrical contact. More previsely, there are two charge leakage paths to earth as follows: firstly, from the wick 12 via metal rod 14*a*, to the metal clips 15, to the conduit 11, through integral support members 29 to electrically conductive frame 20, (which is earthed); and secondly, from the wick 12 via metal rod 13*b*, to metal hook 16, to spring 17, to frame member 19, to the conductive frame 20.

As shown in FIG. 2, the fuser roll 1 and the backup roll 2 are journalled in electrically and thermally insulating bushes 31*a*, 31*b* and 32*a*, 32*b*, respectively in the frame 20, thus inhibiting heat flow from the fuser roll 1 to the machine frame 20.

In view of the embodiment described above, it will be evident to a person skilled in the art that various modifications may be made within the scope of the present invention. For example, the wick 12 may be felted rather than woven, but similarly containing electrically conductive, particularly stainless steel, fibers. The individual fibers in that case may run the full length and/or width of the wick 12 or else they may be provided as a random distribution of shorter fibers in sufficient concentration to render the wick as a whole electrically conductive. In this case too, the base material may be Nomex (trademark).

In a further modification, the sheet-like wick 12 may be dispensed with altogether in favour of the felt pad 21 only, in which case the felt would be rendered conductive as discussed above. In this case the felt pad 21 alone would constitute the conductive wick for supplying the release agent to the fuser roll. However, it would be evident from the foregoing description, that this arrangement may not give such a desirable supply and distribution of release agent as would be obtained using the differential absorption arrangement described with reference to FIGS. 1 and 2.

What we claim is:

1. Fusing apparatus for fixing toner images to copy substrates said apparatus comprising:

a heated fuser roll;

a backup roll cooperating with said fuser roll to form a nip through which said copy substrates are passed;

a sump for storing liquid release agent;

a release agent management system for applying said liquid release agent to the surface of said heated fuser roll and providing a conductive path for leakage of electrostatic charges from said heated fuser roll, said system including electrically conducting means contacting said heated fuser roll; and means for conveying the release agent from said sump to said structure.

2. Apparatus according to claim 1 wherein said electrically conducting means comprises a wick.

3. A fusing apparatus as claimed in claim 2 wherein the material of the wick means comprises electrically conductive threads.

4. A fusing apparatus as claimed in claim 3, wherein each electrically conductive thread comprises one or more electrically conductive fibers entwined with a plurality of electrically insulating fibers.

5. A fusing apparatus as claimed in claim 4, wherein the proportion of conductive fibers to insulating fibers is between 5 and 20%.

6. A fusing apparatus as claimed in claim 2 wherein the wick means comprises a woven fabric.

7. A fusing apparatus as claimed in claim 6, wherein either the warp or the weft only of the woven fabric comprises electrically conductive threads.

8. A fusing apparatus as claimed in claim 6 or claim 7, wherein the wick means comprises a substantially rectangular sheet of the woven fabric extending the length of the fuser roll and supported longitudinally between two electrically conductive rods which are electrically connected to an electrically conductive frame connected to earth potential, within which frame the fusing apparatus is mounted.

9. A fusing apparatus as claimed in claim 2, wherein the wick means comprises a first wick member, and a second wick member disposed between the first wick member and the surface of the fuser roll whereby the liquid release agent is supplied to the surface of said fuser roll from said first wick member via said second wick member, said second wick member being less absorbent than said first wick member.

10. A fusing apparatus as claimed in claim 9, wherein the first wick member is in the form of a felted pad, and the second wick member comprises woven fabric.

11. A fusing apparatus as claimed in claim 9, wherein the first wick member is electrically insulating and the second wick member is electrically conductive.

12. A fusing apparatus as claimed in claim 11, wherein the material of the second wick member comprises electrically conductive threads.

13. A fusing apparatus as claimed in claim 12, wherein each electrically conductive thread comprises one or more electrically conductive fibers entrained with a plurality of electrically insulating fibers.

14. A fusing apparatus as claimed in claim 13, wherein the proportion of conductive fibers to insulating fibers is between 5 and 20%.

* * * * *